US007131244B1

(12) United States Patent
Bradwell

(10) Patent No.: US 7,131,244 B1
(45) Date of Patent: Nov. 7, 2006

(54) DOOR SYSTEM

(76) Inventor: Dennis Bradwell, 1045 S. 51st St., Philadelphia, PA (US) 19143

( * ) Notice: Subject to any disclaimer, the term of this patent is extended or adjusted under 35 U.S.C. 154(b) by 0 days.

(21) Appl. No.: 10/320,563

(22) Filed: Dec. 13, 2002

(51) Int. Cl.
*E04C 2/38* (2006.01)
*A47G 5/00* (2006.01)

(52) U.S. Cl. ..... 52/656.4; 52/656.2; 160/371

(58) Field of Classification Search ..... 52/656.4, 52/656.2, 656.5; 160/371, 369, 90, 381; 49/504, 261, 63, 68
See application file for complete search history.

(56) References Cited

U.S. PATENT DOCUMENTS 2,396,520 A * 3/1946 Mastrangelo ..... 292/241
2,609,222 A * 9/1952 Severson ..... 292/175
3,024,837 A * 3/1962 McPhail ..... 160/91
3,302,351 A * 2/1967 Trulaske ..... 52/309.1
4,079,558 A * 3/1978 Gorham ..... 52/202
4,311,183 A 1/1982 Herbst et al.
4,555,869 A * 12/1985 Kenkel ..... 49/449
5,331,766 A * 7/1994 Bennett ..... 49/449
5,379,824 A * 1/1995 Carvalho ..... 160/90
5,540,026 A 7/1996 Gartland
5,711,125 A 1/1998 Schooling
5,887,391 A * 3/1999 Shoup ..... 52/202
6,209,269 B1 * 4/2001 Valderrama ..... 52/171.3
6,276,091 B1 * 8/2001 Ridgway ..... 49/125
6,390,173 B1 * 5/2002 Story, Jr. ..... 160/371

* cited by examiner

*Primary Examiner*—Ramon O. Ramirez
*Assistant Examiner*—Tan Le

(57) ABSTRACT

A door system for providing a door that is easily constructed and has interchangeable panel members. The door system includes a frame assembly comprising a pair of frame portions. Each of the frame portions defines a window aperture of the frame assembly. The frame assembly is designed for being hingably coupled to a door frame of a house whereby the frame assembly is selectively pivoted adjacent a door of the house when the frame assembly is in a closed position. Each of a plurality of panel members is selectively coupled to the frame assembly whereby the panel members are selectively positioned in the window aperture of each of the frame portions. Each of the panel members is designed for controlling environmental communication between an interior of the house and an exterior of the house when the door of the house adjacent the frame assembly is open.

6 Claims, 3 Drawing Sheets

DOOR SYSTEM

BACKGROUND OF THE INVENTION

1. Field of the Invention

The present invention relates to storm doors and more particularly pertains to a new door system for providing a door that is easily constructed and has interchangeable panel members.

2. Description of the Prior Art

The use of storm doors is known in the prior art. U.S. Pat. No. 4,311,183 describes a device for selectively storing either a storm window of screen when not in use. Another type of storm door is U.S. Pat. No. 5,5540,026 having a panel that is manufactured to appear as a framed panel. U.S. Pat. No. 5,711,125 has a storage building door having enhanced weather durability.

While these devices fulfill their respective, particular objectives and requirements, the need remains for a system that has certain improved features that allows for the panels to be readily removed.

SUMMARY OF THE INVENTION

The present invention meets the needs presented above by providing each of the frame members with channels for receiving the panel members and maintaining the panel members in the window apertures of the frame assembly.

Still yet another object of the present invention is to provide a new door system that provides a frame assembly that can be completely disassembled to allow for easier transportation and storage.

To this end, the present invention generally comprises a frame assembly comprising a pair of frame portions. One of the frame portions is coupled to the other of the frame portions. Each of the frame portions defines a window aperture of the frame assembly. The frame assembly is designed for being hingably coupled to a door frame of a house whereby the frame assembly is selectively pivoted adjacent a door of the house when the frame assembly is in a closed position. Each of a plurality of panel members is selectively coupled to the frame assembly whereby the panel members are selectively positioned in the window aperture of each of the frame portions. Each of the panel members is designed for controlling environmental communication between an interior of the house and an exterior of the house when the door of the house adjacent the frame assembly is open.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
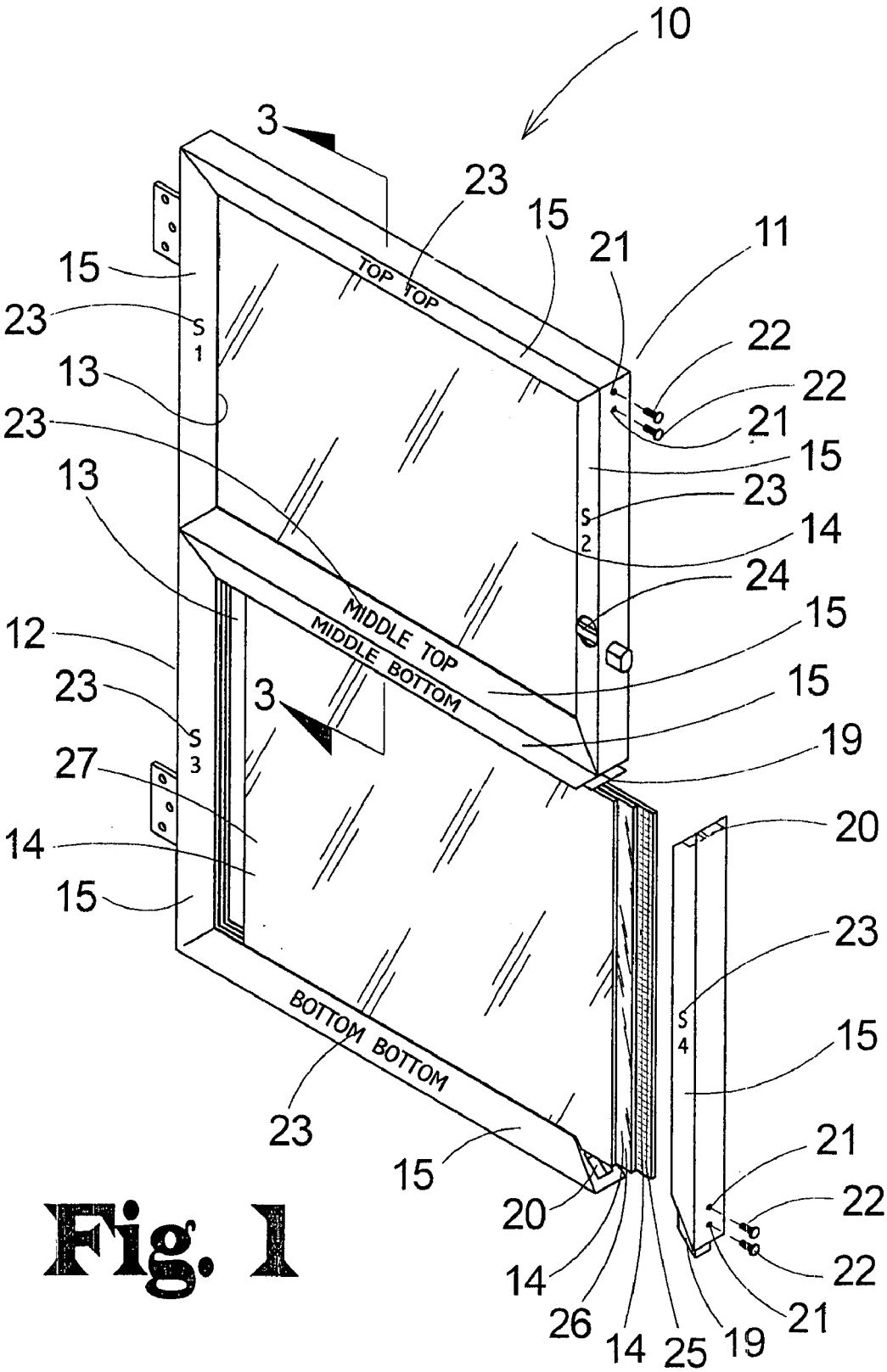
FIG. 1 is a perspective view of a new door system according to the present invention shown in use.
Figure 2:
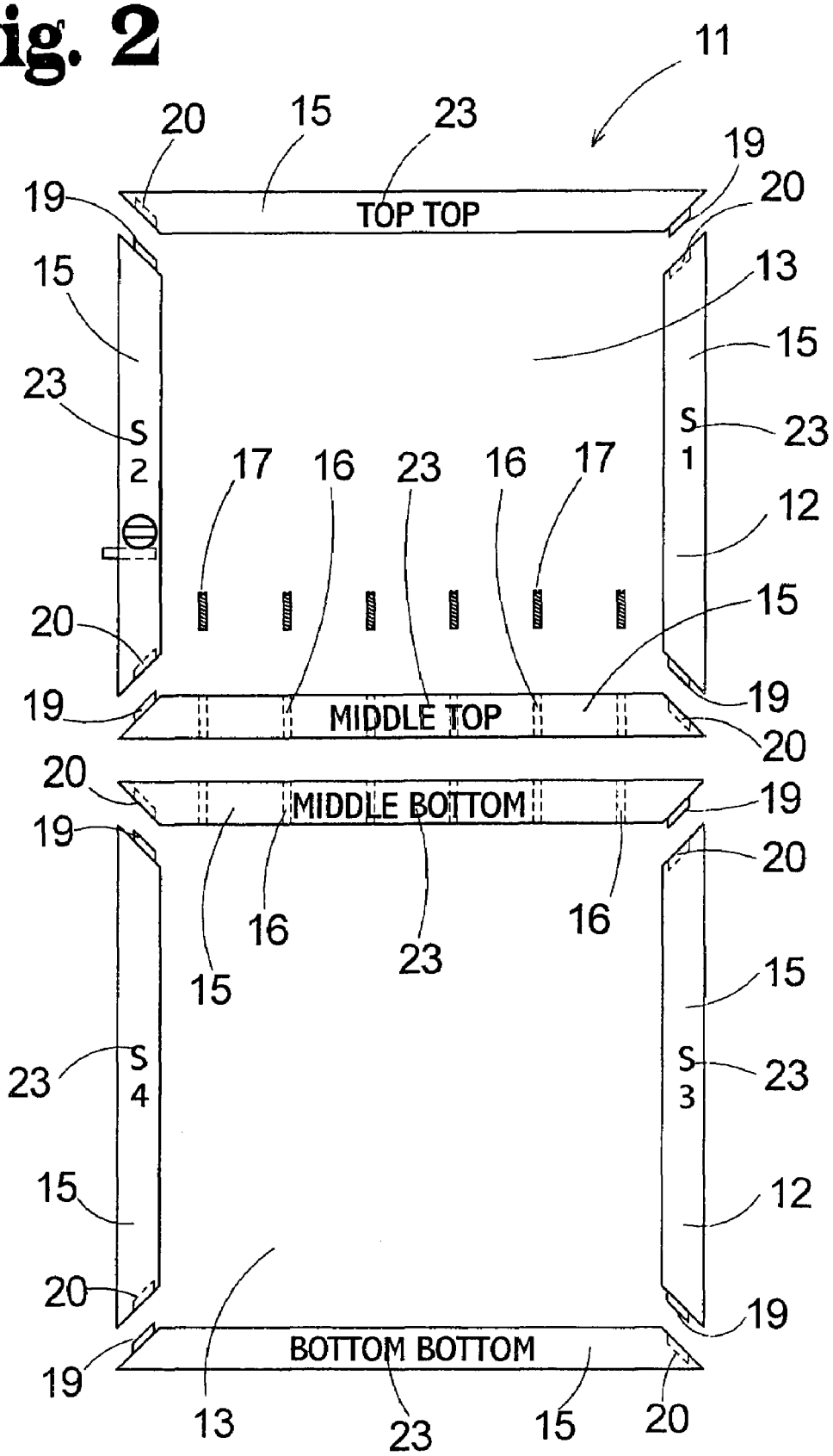
FIG. 2 is a rear explode view of the frame assembly of the present invention.
Figure 3:
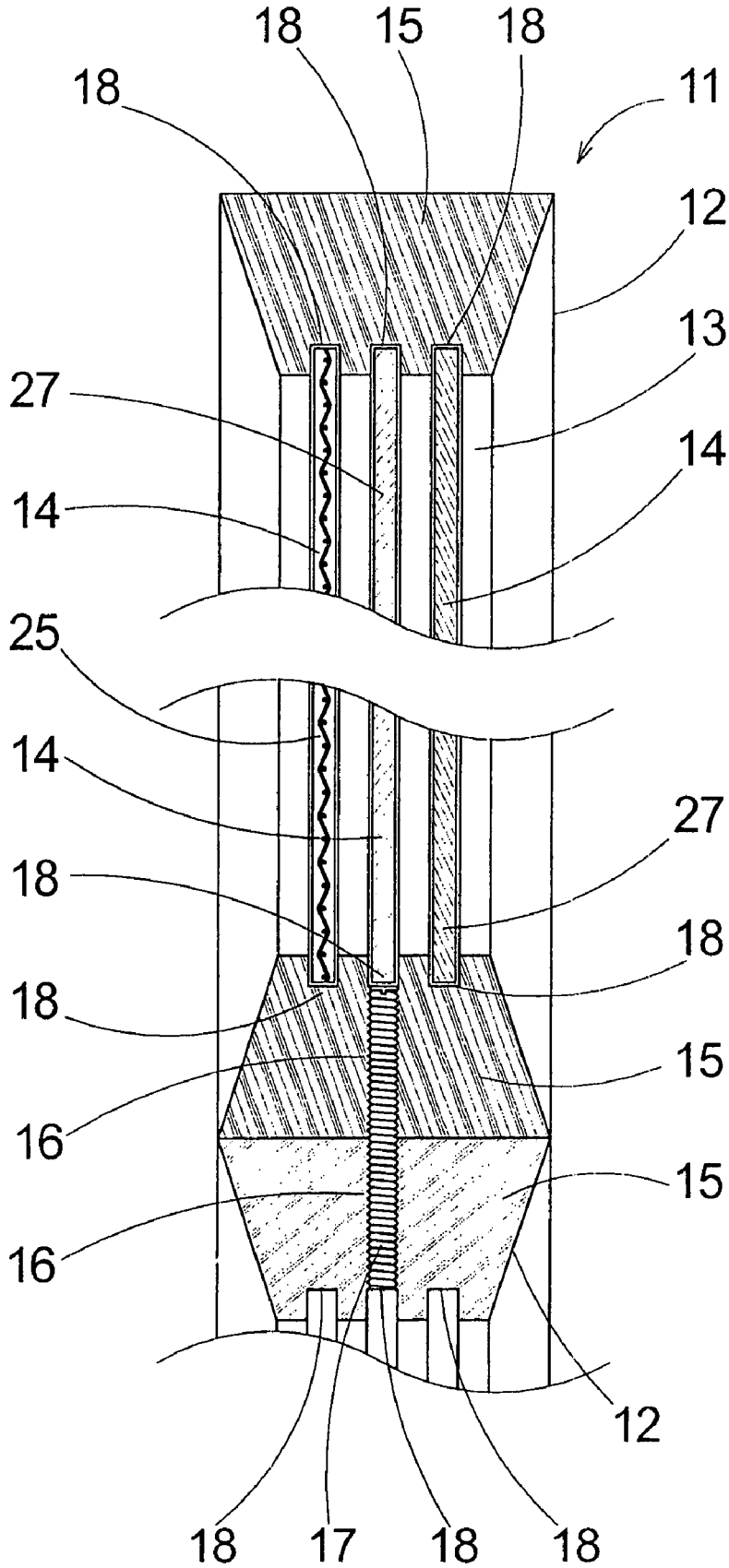
FIG. 3 is a cross-sectional view of the present invention taken along line 3—3 of FIG. 1.

With reference now to the drawings, and in particular to FIGS. 1 through 3 thereof, a new door system embodying the principles and concepts of the present invention and generally designated by the reference numeral 10 will be described.

As best illustrated in FIGS. 1 through 3, the door system 10 generally comprises a frame assembly 11 comprising a pair of frame portions 12. One of the frame portions 12 is coupled to the other of the frame portions 12. Each of the frame portions 12 defines a window aperture of the frame assembly 11. The frame assembly 11 is designed for being hingably coupled to a door frame of a house whereby the frame assembly 11 is selectively pivoted adjacent a door of the house when the frame assembly 11 is in a closed position.

Each of a plurality of panel members 14 is selectively coupled to the frame assembly 11 whereby the panel members 14 are selectively positioned in the window aperture of each of the frame portions 12. Each of the panel members 14 is designed for controlling environmental communication between an interior of the house and an exterior of the house when the door of the house adjacent the frame assembly 11 is open.

Each of the frame portions 12 comprises a plurality of frame members 15. Each of the frame members 15 is selectively coupled to adjacent frame members 15 whereby the frame members 15 define one of the window apertures 13 of the frame assembly 11. One of the frame members 15 of each of the frame portions 12 is designed for being hingably coupled to the door frame of the house. The frame members 15 are for framing the panels when the panels are positioned in the window apertures 13 of the frame assembly 11. One of the frame members 15 of one of the frame portions 12 is selectively coupled to one of the frame members 15 of the other of the frame portions 12 to form the frame assembly 11. One of each of the frame members 15 of each of the frame portions 12 has a plurality of mounting apertures 16 extending through the associated one of the frame members 15. Each of the mounting apertures 16 of the associated one of the frame members 15 of one of the frame portions 12 being aligned with one of the mounting apertures 16 of the associated one of the frame members 15 of the other of the frame portions 12 and receiving one of a plurality of mounting fasteners 17 to mount one of the frame portions 12 to the other of the frame portions 12.

Each of the frame members 15 comprises a plurality of channels 18. Each of the channels 18 of each of the frame members 15 is in communication with the channels 18 of adjacent frame members 15 of the associated one of the frame portions 12. Each of the channels 18 of each of the frame members 15 selectively receives one of the panel members 14 whereby the channels 18 of the frame members 15 are for maintaining positioning of the panel members 14 when the panel members 14 are positioned in the window apertures 13 of the frame assembly 11. One of the frame members 15 of each of the frame portions 12 is selectively removable from adjacent frame members 15 for permitting selective removal of the panel members 14 from the channels 18 of the frame members 15 of the associated one of the frame portions 12.

Each of the frame members 15 comprises a tab portion 19 and a receiving slot 20. The tab portion 19 outwardly extends from an end of the associated one of the frame members 15. The receiving slot 20 extends into the associated one of the frame members 15 opposite the tab portion 19 of the associated one of the frame members 15. The receiving slot 20 selectively receives the tab portion 19 of an adjacent one of the frame members 15 for selectively coupling the associated one of the frame members 15 to the adjacent one of the frame members 15.

At least one of the frame members 15 of each of the frame portions 12 comprises a plurality of a securing apertures 21. Each of the securing apertures 21 selectively receives one of a plurality of securing fasteners 22 whereby the securing fasteners 22 extend through the associated one of the frame members 15 and into an adjacent one of the frame members 15 for securing the frame members 15 together.

Each of the frame members 15 of each of the frame portions 12 comprises an indicator indicia 23. The indicator indicia 23 indicates an order of orientation of the frame members 15 to form the associated one of the frame portions 12 when the frame members 15 are selectively coupled together.

A latching assembly 24 is coupled to one of the frame portions 12. The latching assembly 24 is designed for engaging the door frame of the house for inhibiting inadvertent opening of the frame assembly 11 when the latching assembly 24 is actuated by the user.

The panel members 14 comprise a pair of screen members 25. The screen members 25 are selectively positionable in one of the channels 18 of the frame members 15 of the associated one of the frame portions 12 for positioning the screen members 25 in the window apertures 13 of the frame assembly 11. The screen members 25 are designed for permitting air to flow between the exterior of the house and the interior of the house whereby the screen members 25 are for inhibiting insects from entering the house when the door of the house is open.

The panel members 14 comprise a pair of transparent panels 26. The transparent panels 26 are selectively positionable in one of the channels 18 of the frame members 15 of the associated one of the frame portions 12 for positioning the transparent panels 26 in the window apertures 13 of the frame assembly 11. The transparent panels 26 are designed for inhibiting air flow between the interior of the house and the exterior of the house and letting a user view through the transparent panels 26 when the door of the house is open.

The panel members 14 comprise a pair of translucent panels 27. The translucent panels 27 are selectively positionable in one of the channels 18 of the frame members 15 of the associated one of the frame portions 12 for positioning the translucent panels 27 in the window apertures 13 of the frame assembly 11. The translucent panels 27 are designed for diffusing light passing through the translucent panels 27 to obscure the view of the user through the translucent panels 27 when the door of the house is open.

In use, the user assembles couples the frame members 15 together to form the frame portions 12 using the indicator indicia 23 to properly orientate the frame members 15 in the proper order. The mounting apertures 16 of the frame portions 12 are then aligned and the mounting fasteners inserted into the mounting apertures 16 to secure the frame portions 12 together. The desired panel members 14 are slid into the channels 18 and the remaining frame member secured to the others to inhibit the panel members 14 from inadvertently sliding out of the channels 18. The latching assembly 24 can be actuated by the user to secure the frame assembly 11 to the door frame to keep the frame assembly 11 in the closed position. One of the frame members 15 can be removed to allow for the panel members 14 to changed as desired by the user.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A door system comprising:

a frame assembly comprising a pair of frame portions, one of said frame portions being coupled to the other of said frame portions, each of said frame portions defining a window aperture of said frame assembly, said frame assembly being adapted for being hingably coupled to a door frame of a house such that said frame assembly is selectively pivoted adjacent a door of the house when said frame assembly is in a closed position;

a plurality of panel members, each of said panel members being selectively mountable on said frame assembly such that said panel members are selectively positioned in said window aperture of each of said frame portions, each of said panel members being adapted for controlling environmental communication between an interior of the house and an exterior of the house when the door of the house adjacent said frame assembly is open;

each of said frame portions comprising a plurality of frame members, each of said frame members being selectively coupled to adjacent frame members such that said frame members define one of said window apertures of said frame assembly, one of said frame members of each of said frame portions being adapted for being hingably coupled to the door frame of the house, said frame members being for framing said panels when said panels are positioned in said window apertures of said frame assembly, one of said frame members of one of said frame portions being selectively coupled to one of said frame members of the other of said frame portions to form said frame assembly;

wherein each of said frame members comprises a plurality of channels, each of said channels of each of said frame members being in communication with said channels of adjacent frame members of the associated one of said frame portions, each of said channels of each of said frame members selectively receiving one of said panel members such that said channels of said frame members maintain a position of said panel members when said panel members are positioned in said window apertures of said frame assembly;

wherein one of said frame members of each of said frame portions is selectively removable from adjacent frame members for permitting selective removal of said panel members from said channels of said frame members of the associated one of said frame portions;

wherein said plurality of panel members include a pair of screen members, each of said screen members being selectively positionable in said window aperture of one of said frame assemblies;

wherein said plurality of panel members include a pair of transparent panels, each of said transparent panels being selectively positionable in said window aperture of each of said frame assemblies; and wherein said plurality of panel members include a pair of translucent panels, each of said translucent panels being selectively positionable in said window aperture of each of said frame assemblies.

2. The door system as set forth in claim 1, further comprising:

each of said frame members comprising a tab portion and a receiving slot, said tab portion outwardly extending from an end of the associated one of said frame members, said receiving slot extending into the associated one of said frame members opposite said tab portion of the associated one of said frame members, said receiving slot selectively receiving said tab portion of an adjacent one of said frame members for selectively coupling the associated one of said frame members to the adjacent one of said frame members.

3. The door system as set forth in claim 2, further comprising:

at least one of said frame members of each of said frame portions comprising a plurality of a securing apertures, each of said securing apertures selectively receiving one of a plurality of securing fasteners such that said securing fasteners extend through the associated one of said frame members and into an adjacent one of said frame members for securing said frame members together.

4. The door system as set forth in claim 1, further comprising:

each of said frame members of each of said frame portions comprising an indicator indicia, said indicator indicia indicating an order of orientation of said frame members to form the associated one of said frame portions when said frame members are selectively coupled together.

5. The door system as set forth in claim 1, further comprising:

a latching assembly being coupled to one of said frame portions, said latching assembly being adapted for engaging the door frame of the house for inhibiting inadvertent opening of said frame assembly when said latching assembly is actuated by the user.

6. A door system comprising:

a frame assembly comprising a pair of frame portions, one of said frame portions being coupled to the other of said frame portions, each of said frame portions defining a window aperture of said frame assembly, said frame assembly being adapted for being hingably coupled to a door frame of a house such that said frame assembly is selectively pivoted adjacent a door of the house when said frame assembly is in a closed position;

each of a plurality of panel members being selectively coupled to said frame assembly such that said panel members are selectively positioned in said window aperture of each of said frame portions, each of said panel members being adapted for controlling environmental communication between an interior of the house and an exterior of the house when the door of the house adjacent said frame assembly is open;

each of said frame portions comprising a plurality of frame members, each of said frame members being selectively coupled to adjacent frame members such that said frame members define one of said window apertures of said frame assembly, one of said frame members of each of said frame portions being adapted for being hingably coupled to the door frame of the house, said frame members being for framing said panels when said panels are positioned in said window apertures of said frame assembly, one of said frame members of one of said frame portions being selectively coupled to one of said frame members of the other of said frame portions to form said frame assembly;

each of said frame members comprising a plurality of channels, each of said channels of each of said frame members being in communication with said channels of adjacent frame members of the associated one of said frame portions, each of said channels of each of said frame members selectively receiving one of said panel members such that said channels of said frame members are for maintaining positioning of said panel members when said panel members are positioned in said window apertures of said frame assembly, one of said frame members of each of said frame portions being selectively removable from adjacent frame members for permitting selective removal of said panel members from said channels of said frame members of the associated one of said frame portions;

each of said frame members comprising a tab portion and a receiving slot, said tab portion outwardly extending from an end of the associated one of said frame members, said receiving slot extending into the associated one of said frame members opposite said tab portion of the associated one of said frame members, said receiving slot selectively receiving said tab portion of an adjacent one of said frame members for selectively coupling the associated one of said frame members to the adjacent one of said frame members;

at least one of said frame members of each of said frame portions comprising a plurality of a securing apertures, each of said securing apertures selectively receiving one of a plurality of securing fasteners such that said securing fasteners extend through the associated one of said frame members and into an adjacent one of said frame members for securing said frame members together;

each of said frame members of each of said frame portions comprising an indicator indicia, said indicator indicia indicating an order of orientation of said frame members to form the associated one of said frame portions when said frame members are selectively coupled together;

a latching assembly being coupled to one of said frame portions, said latching assembly being adapted for engaging the door frame of the house for inhibiting inadvertent opening of said frame assembly when said latching assembly is actuated by the user;

said panel members comprising a pair of screen members, said screen members being selectively positionable in one of said channels of said frame members of the associated one of said frame portions for positioning said screen members in said window apertures of said frame assembly, said screen members being adapted for permitting air to flow between the exterior of the house and the interior of the house such that said screen members are for inhibiting insects from entering the house when the door of the house is open;

said panel members comprising a pair of transparent panels, said transparent panels being selectively positionable in one of said channels of said frame members of the associated one of said frame portions for positioning said transparent panels in said window apertures of said frame assembly, said transparent panels being adapted for inhibiting air flow between the interior of the house and the exterior of the house and letting a user view through said transparent panels when the door of the house is open; and said panel members comprising a pair of translucent panels, said translucent panels being selectively positionable in one of said channels of said frame members of the associated one of said frame portions for positioning said translucent panels in said window apertures of said frame assembly, said translucent panels being adapted for diffusing light passing through said translucent panels to obscure the view of the user through said translucent panels when the door of the house is open.

* * * * *